US007364534B2

(12) United States Patent
Zoller et al.

(10) Patent No.: US 7,364,534 B2
(45) Date of Patent: Apr. 29, 2008

(54) EXERCISE DEVICE FOR FOOT, ANKLE AND/OR SHIN

(75) Inventors: Robert Gregory Zoller, 4693 Slade Dr., Fairfield, OH (US) 45014; Anthony Joseph Honerkamp, Cincinnati, OH (US)

(73) Assignee: Robert Gregory Zoller, Fairfield, OH (US)

( * ) Notice: Subject to any disclaimer, the term of this patent is extended or adjusted under 35 U.S.C. 154(b) by 226 days.

(21) Appl. No.: 10/744,290

(22) Filed: Dec. 23, 2003

(65) Prior Publication Data

US 2005/0137065 A1 Jun. 23, 2005

(51) Int. Cl.
*A63B 2/60* (2006.01)

(52) U.S. Cl. ..... 482/80; 482/79

(58) Field of Classification Search ..... 482/79, 482/80, 148, 114, 118, 145, 146; 601/27–37
See application file for complete search history.

(56) References Cited

U.S. PATENT DOCUMENTS

| | | | | | |
|---|---|---|---|---|---|
| 189,011 | A | * | 4/1877 | Berne | 168/25 |
| 478,166 | A | | 7/1892 | Madsen | |
| 1,509,793 | A | | 9/1924 | Thompson | |
| 2,206,902 | A | | 7/1940 | Kost | |
| 2,374,730 | A | * | 5/1945 | Catlin | 606/237 |
| 2,573,808 | A | * | 11/1951 | Ravoire | 482/71 |
| 3,134,591 | A | | 5/1964 | Conn et al. | |
| 3,297,320 | A | | 1/1967 | Benedetto | |
| 3,625,203 | A | | 12/1971 | Wadelton | |
| 3,782,721 | A | * | 1/1974 | Passera | 482/117 |
| 3,917,261 | A | | 11/1975 | Small et al. | |
| D251,076 | S | | 2/1979 | Ide | |
| D251,313 | S | | 3/1979 | Jinotti | |
| 4,159,111 | A | * | 6/1979 | Lowth | 482/80 |
| 4,186,920 | A | | 2/1980 | Fiore et al. | |
| 4,199,137 | A | | 4/1980 | Giguere | |
| 4,501,421 | A | * | 2/1985 | Kane et al. | 482/80 |
| D281,343 | S | | 11/1985 | Krive | |
| 4,733,859 | A | | 3/1988 | Kock et al. | |
| 4,739,986 | A | | 4/1988 | Kucharik et al. | |
| 4,862,875 | A | | 9/1989 | Heaton | |
| 4,998,720 | A | | 3/1991 | Kim | |
| 5,035,421 | A | | 7/1991 | Scheller | |
| 5,127,892 | A | | 7/1992 | Sawdon | |
| 5,221,242 | A | | 6/1993 | Weber et al. | |
| 5,230,675 | A | | 7/1993 | Lin | |
| 5,256,118 | A | | 10/1993 | Chen | |
| 5,263,910 | A | | 11/1993 | Yang | |
| 5,267,923 | A | | 12/1993 | Plaget et al. | |
| 5,267,924 | A | | 12/1993 | Miller et al. | |
| 5,304,106 | A | | 4/1994 | Gresko | |
| 5,352,185 | A | | 10/1994 | Blauth et al. | |
| 5,368,535 | A | | 11/1994 | Twardokens | |

(Continued)

*Primary Examiner*—Jerome Donnelly
(74) *Attorney, Agent, or Firm*—Jagtiani + Guttag LLLP

(57) ABSTRACT

An exercise device for providing resisted movement of the ankle through the full range of motion thereof to exercise the muscles in the ankle, foot, lower leg and especially shin area. This exercise device comprises: (a) a base; and (b) a foot receiving member having an ankle section. The foot receiving member is mounted on the base for resisted pivotal movement about: (1) a substantially horizontal axis extending transversely and underneath the ankle section of the foot receiving member; and (2) a substantially vertical axis extending from the base and through the ankle section of the foot receiving member.

20 Claims, 5 Drawing Sheets

U.S. PATENT DOCUMENTS 5,368,536 A 11/1994 Stodgell
5,413,543 A 5/1995 Drago
5,536,226 A 7/1996 Gordon
5,583,407 A * 12/1996 Yamaguchi ..... 318/551
5,645,516 A 7/1997 Foster
5,667,462 A 9/1997 Gordon
5,683,337 A * 11/1997 Zetocha et al. ..... 482/146
5,722,919 A 3/1998 Timmer
D397,746 S 9/1998 Drach et al.
5,813,958 A 9/1998 Tomita
5,891,002 A 4/1999 Maki
5,897,464 A 4/1999 Mcleod
5,935,047 A 8/1999 Cawley
6,063,010 A 5/2000 Howd et al.
6,589,141 B1 7/2003 Flaggs
6,740,011 B1 * 5/2004 Tsai et al. ..... 482/80
2002/0165069 A1 11/2002 Ravikumar et al.

* cited by examiner

EXERCISE DEVICE FOR FOOT, ANKLE AND/OR SHIN

TECHNICAL FIELD

This invention relates to an exercise device for strengthening muscles in the foot, ankle and lower leg, especially the shin.

BACKGROUND OF THE INVENTION

The human ankle joint is capable of a wide range of motion. Such motion includes dorsiflexion (moving the foot upwardly), plantarflexion (moving the foot downwardly), adductor (moving the foot inwardly toward the midline of the body) and abductor (moving the foot outwardly away from the midline of the body). Because the ankle joint supports the entire weight of the body during upright movement, it is, at times, subjected to severe stresses that can cause injury. This can occur while working, while performing day-to-day activities and especially during athletic activity. Due to such circumstances, ankle joint injuries are among the most common injuries suffered.

Moreover, the ankle joint plays an important role in maintaining balance. As individuals age and/or deteriorate due to disease, the ankle joint is commonly affected. This, in turn, compromises the individual's ability to keep their balance and places the individual at serious risk of suffering a harmful fall.

Medical treatment of an injury to the ankle joint (such as a sprain, strain or break) commonly entails immobilization of the soft tissues that encompass the joint. In fact, the muscles, ligaments, and tendons of the joint are often immobilized for a sufficient period of time thereby causing them to become weakened or atrophied. Thus, after the initial and pain swelling associated with the acute injury has diminished, it is important to rehabilitate the ankle to restore stability, to restore range of motion, and to increase strength in the affected soft tissues of the ankle joint.

One way this can be accomplished is by exercising the muscles surrounding the ankle, lower leg and foot through a desired range of motion on a device that is capable of providing resistance to such movement. Indeed, a frequently neglected muscle group for exercise injury prevention and rehabilitation is the shin. The major muscles responsible for dorsiflexion (i.e., tibialis anterior and extension hallicusis longus) are all present in the shin area. Moreover, by strengthening the muscles in the lower leg and foot, one may significantly reduce the possibility of future ankle injuries. Additionally, by improving strength and range of motion, balance can be improved.

Many exercise devices have been taught in the art. The ability of the exercise device to provide resistance to the ankle through the full range of motion is especially important in strengthening the muscles in ankle, foot and especially the shin area. Several of these prior devices provide exercise only by ankle and/or foot movement or motion in one direction, or in a very limited number of directions. See, for example, U.S. Pat. No. 1,509,793 (Thompson), issued Sep. 23, 1924 (exercise apparatus for the feet having foot treadle whose movement is guided in a slightly curved up or down path while pivoting on ball joint); U.S. Pat. No. 5,897,464 (Mcleod), issued Apr. 27, 1999 (device for exercising the ankle that can pivot up or down or be rocked from side-to-side where the foot plate can also be rotated laterally to position the foot at different angles); U.S. Pat. No. 5,368,535 (Twardokens), issued Nov. 29, 1994 (weighted exercising device where the foot can be rotated laterally against resistance provided by a tensioned cable). As a result, these prior devices do not provide, for example, all of the dorsiflexion and plantarflexion motion, coupled with adductor and abductor motion necessary to exercise of the ankle throughout the full range of motion.

Many of these prior exercise or rehabilitation devices involve rocking on a ball-type joint and thus provide little, if any, resistance to movement of the ankle through its full range of motion. See U.S. Pat. No. 478,166 (Madsen), issued Jul. 5, 1892; U.S. Pat. No. 2,206,902 (Kost), issued Jul. 9, 1940; U.S. Pat. No. 4,186,920 (Fiore et al), issued Feb. 5, 1980; U.S. Pat. No. 4,199,137 (Giguere), issued Apr. 22, 1980; and U.S. Pat. No. 5,368,536 (Stodgell), issued Nov. 29, 1994. See also U.S. Pat. Nos. 5,536,226 and 5,667,462 (Gordon), issued Jul. 16, 1996 and Sep. 16, 1997, which disclose an exercise and physical therapy device for the foot and ankle that is pivoted about a single torsion device underneath the arch of the foot to provide up or down, or side-to-side rocking movement. Other devices are only directed at improving the balance and coordination of the user, rather than exercising a particular muscle or group of muscles in the ankle, foot or lower leg. See U.S. Pat. No. 3,134,591 (Conn et al), issued May 26, 1954, which discloses a rotatably mounted foot exercise device so that user can spin at a very high rate of speed to develop balance, skill and coordination.

Accordingly, there still remains a need for exercise devices to strengthen the muscles of the ankle, foot and lower leg, especially the shin, and particularly to provide resistance to the full range of motion of the ankle.

BRIEF DESCRIPTION OF THE INVENTION

This invention is broadly directed at an exercise device for providing resisted movement of the ankle through the full range of motion thereof to exercise the muscles in the ankle, foot, lower leg, and especially the shin area. This exercise device comprises:

A. a base; and

B. a foot receiving member having an ankle section;

C. the foot receiving member being mounted on the base for resisted pivotal movement about:

1. a substantially horizontal axis extending transversely and underneath the ankle section of the foot receiving member; and
2. a substantially vertical axis extending from the base and through the ankle section of the foot receiving member.

The exercise device of this invention provides a number of benefits for the user thereof. This device allows for resisted movement of the ankle joint through the full range of motion, including dorsiflexion, plantarflexion, adductor and abductor, and in any particularly desired combination of such motions. In particular, this device provides strengthening and/or rehabilitation of the muscles and tendons in the foot and lower leg, especially those of the shin, as well as the anterior portion of the foot and lower leg. The device can accommodate differing foot sizes of various users, and is easily adjustable to change the degree of resisted pivotal movement to meet the exercise and strength needs of the user.

DETAILED DESCRIPTION OF THE INVENTION

As used herein, the term "comprising" means various components, steps and the like can be conjointly employed in this invention. Accordingly, the term "comprising" encompasses the more restrictive terms "consisting essentially of" and "consisting of."

Figure 1:
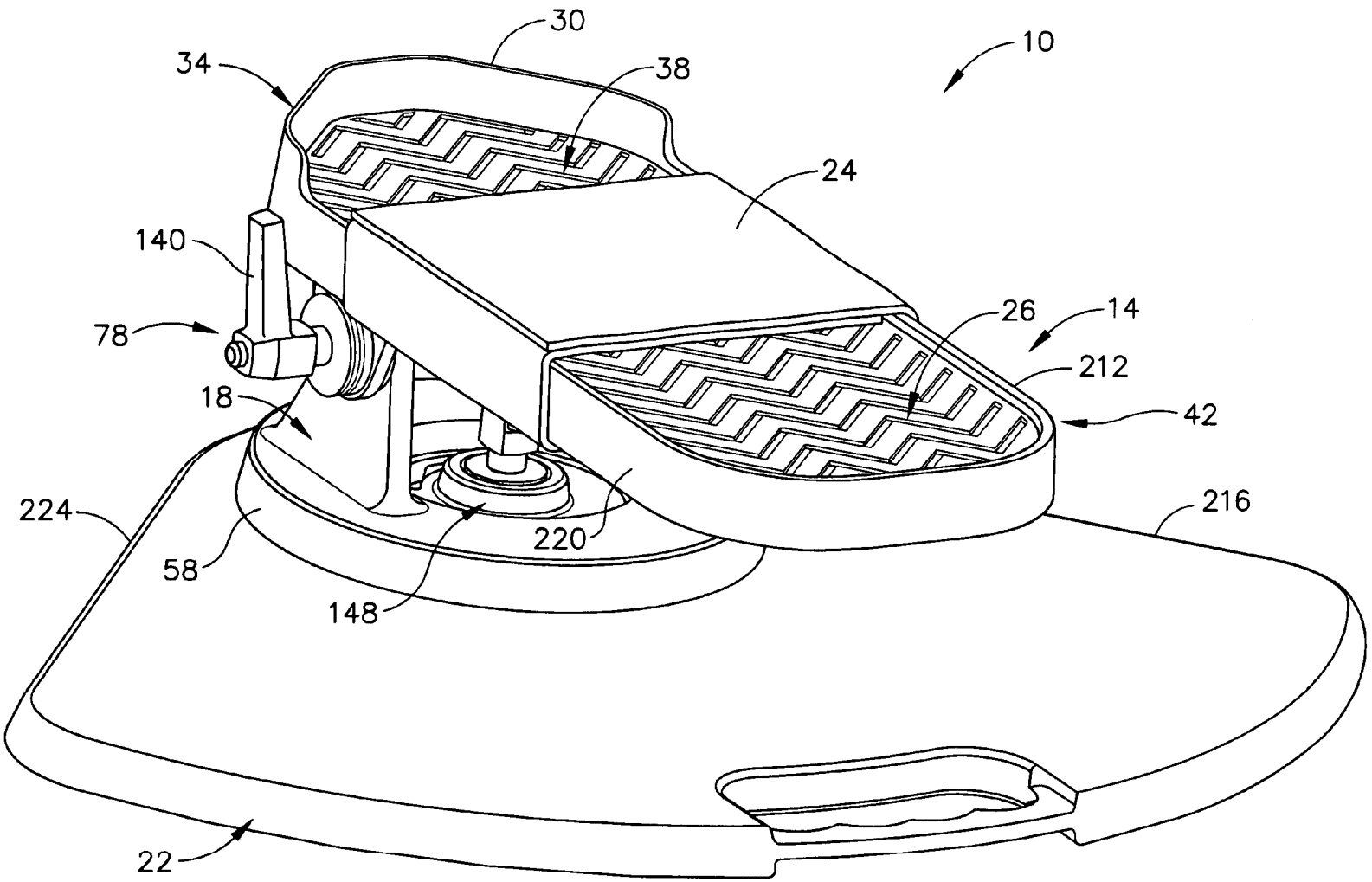
FIG. 1 is a perspective view of an embodiment of the exercise device of this invention.
Figure 2:
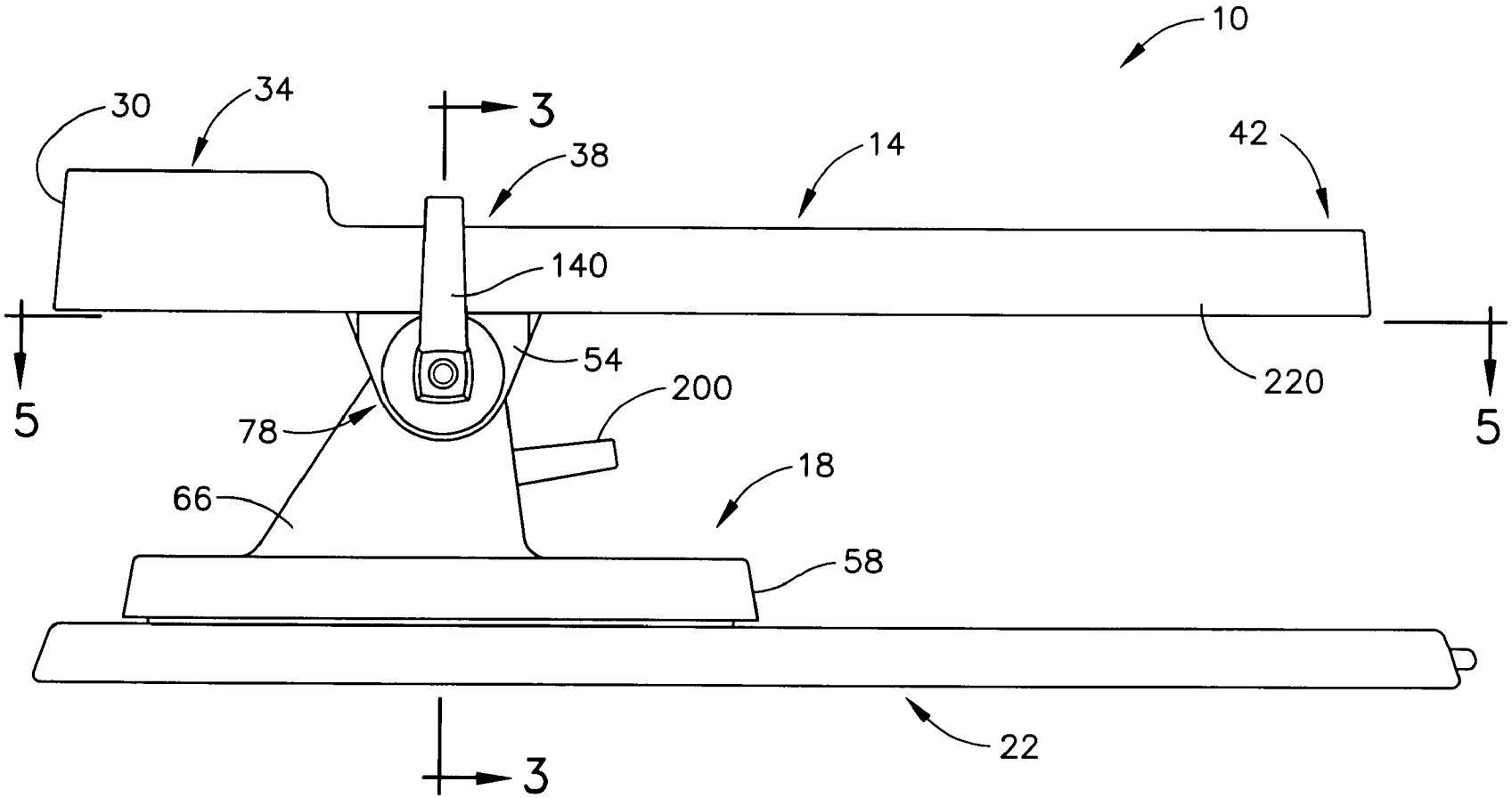
FIG. 2 is a side view of the embodiment of FIG. 1.

The various embodiments of this invention are further illustrated by reference to the drawings as described hereafter. Referring to the drawings, FIG. 1 shows an embodiment of the exercise device generally indicated as 10. Exercise device 10 generally comprises a foot receiving member in the form of a foot pad indicated generally as 14, a mount member in the form of a mounting bracketing indicated generally as 18, and a base member indicated generally as 22. The user places their foot in or on foot pad 14, the user's foot then being releasably secured to foot pad 14 by a foot securing member, such as an adjustable velcro type-strap indicated generally as 24 that is typically attached or secured underneath foot pad 14. Foot pad 14 is also shown as having a tread pattern in the upper surface 26 thereof and a seat or shoulder 30 at the back or heal thereof to minimize sliding of the foot of the user after it is secured by strap 24. As shown in FIGS. 1 and 2, foot pad 14 has a back heel section indicated generally as 34, an intermediate ankle section indicated generally as 38 that is adjacent to and forward of heel section 34, and a front toe section indicated generally as 42 that is adjacent to and forward of ankle section 38. Strap 24 can be adjustably secured underneath foot pad 14 at any position along the length thereof depending on the needs and foot size of the user, but is typically positioned/secured somewhere between ankle section 38 and toe section 42.

Figure 3:
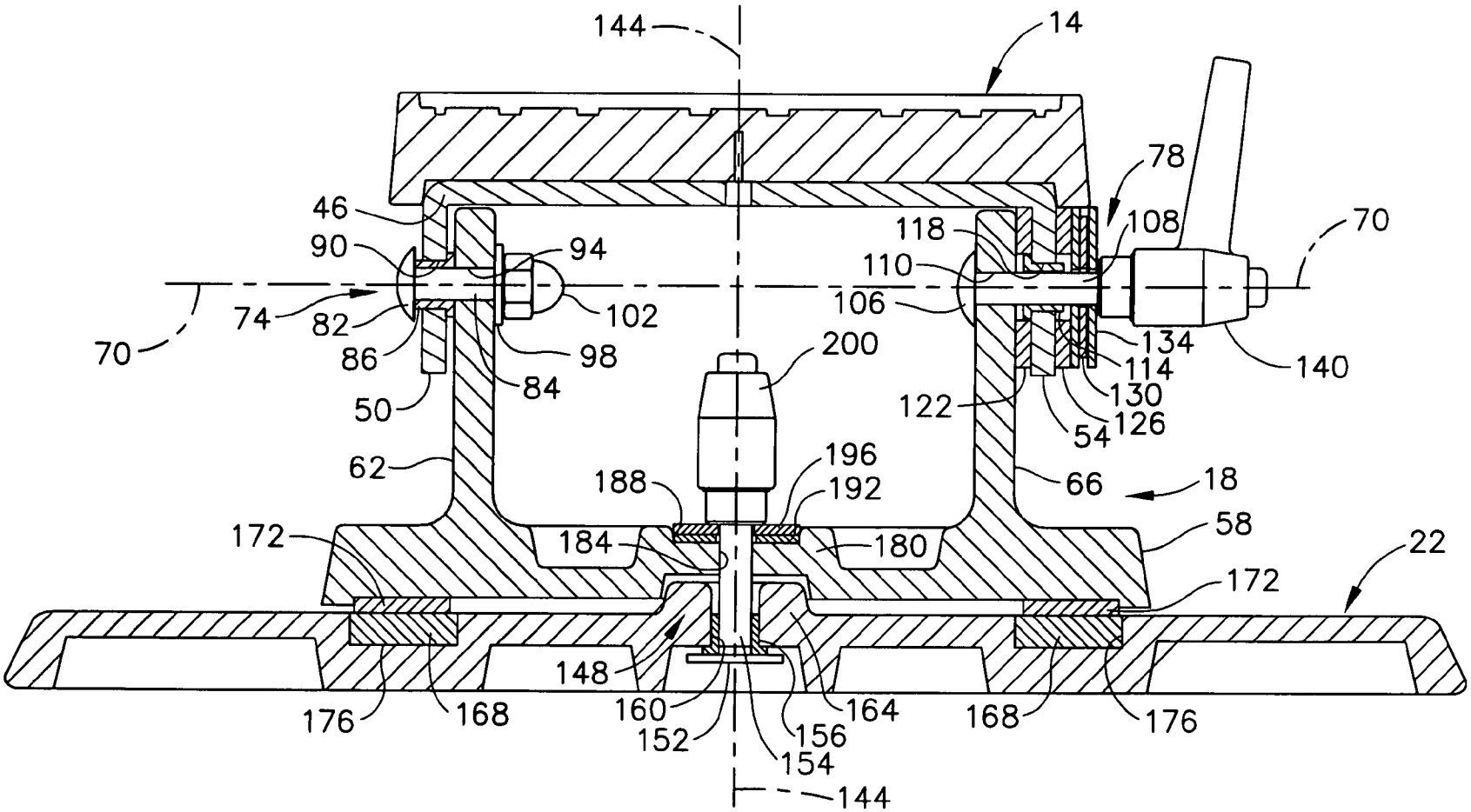
FIG. 3 is a sectional view taken along line 3-3 of FIG. 2.
Figure 4:
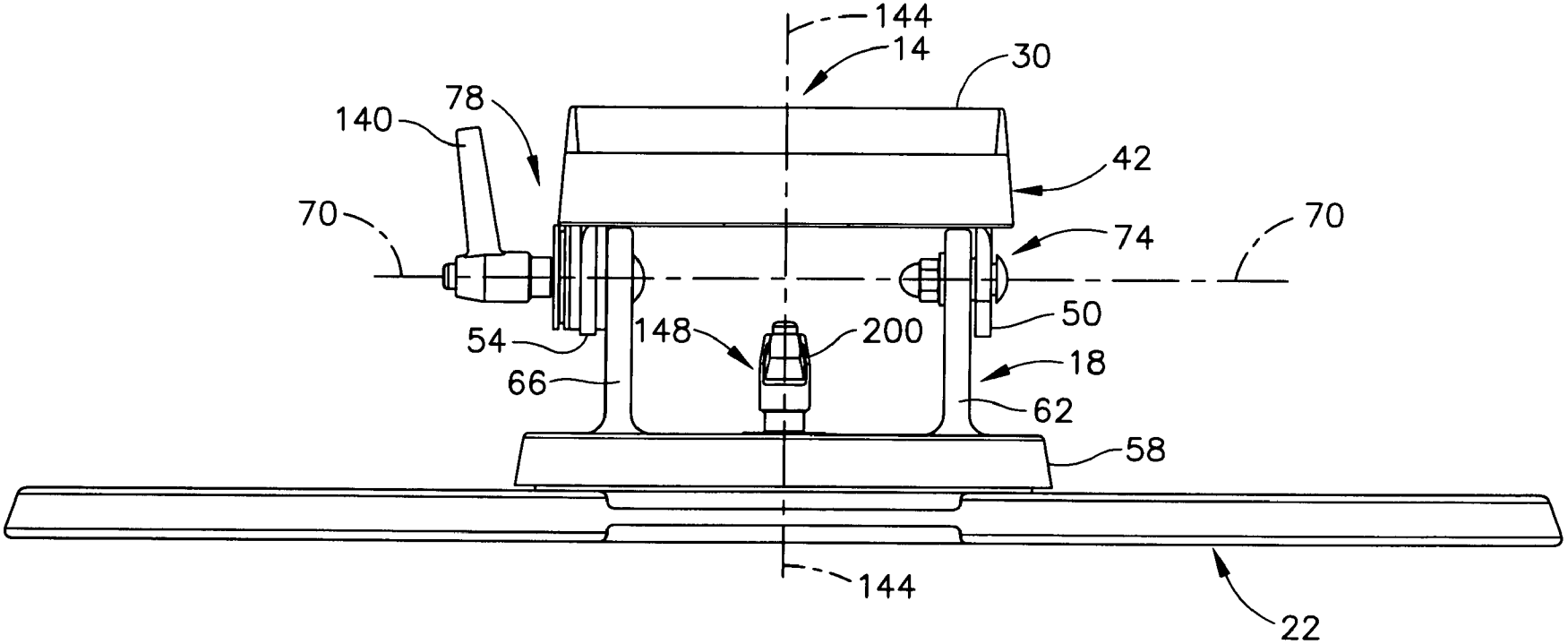
FIG. 4 is a front view of the embodiment of FIG. 1
Figure 5:
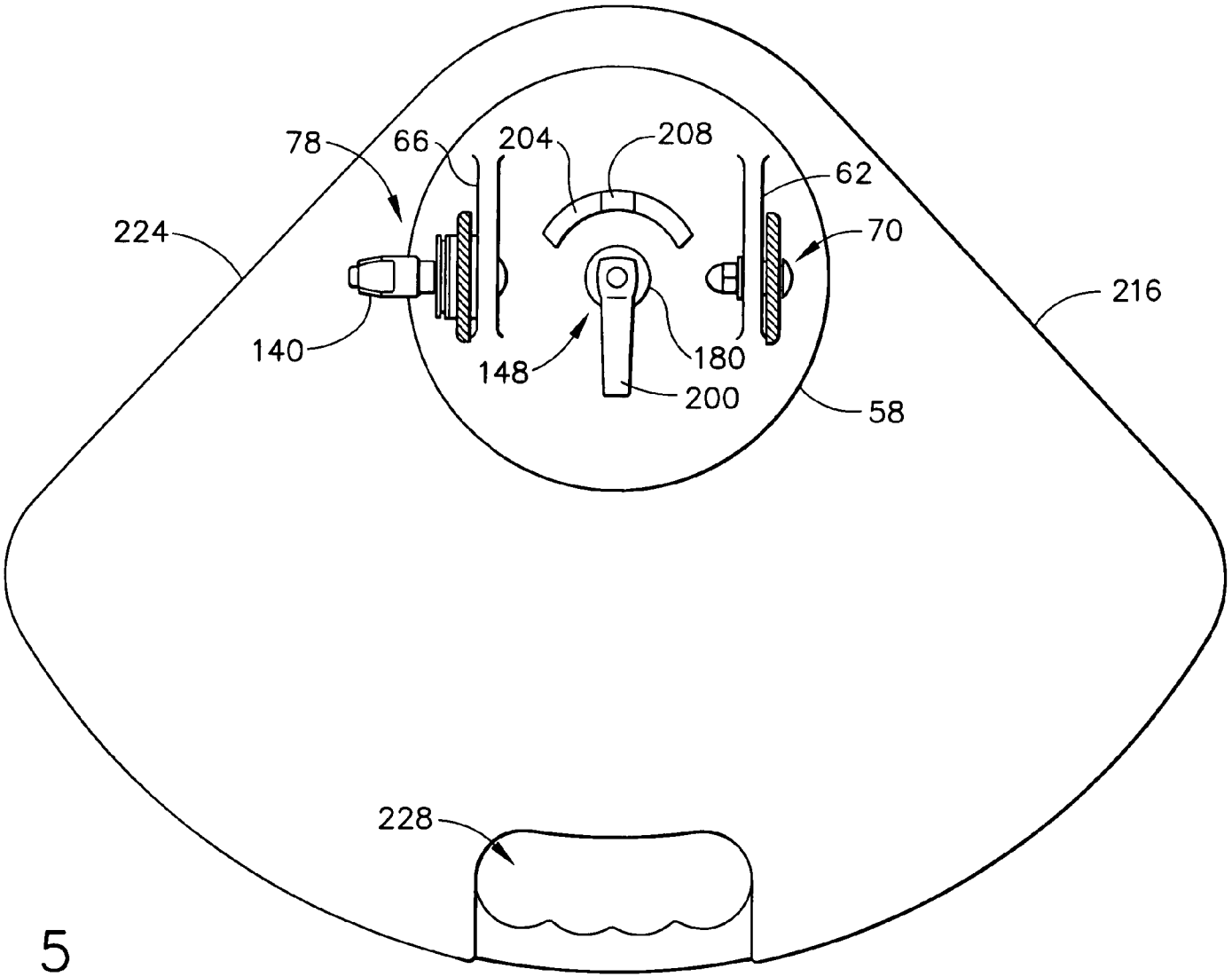
FIG. 5 is a sectional view taken along line 5-5 of FIG. 2.

As shown particularly in FIGS. 3 and 4, foot pad 14 is pivotally secured, attached or otherwise mounted on mounting bracket 18 by the use of a support bracket indicated generally as 46 that is attached or secured to the underside of foot pad 14, or which alternatively can be formed integrally with the underside of foot pad 14. Support bracket 46 has a pair of generally triangularly-shaped spaced apart arms 50 and 54 that extend generally downwardly underneath ankle section 38 of foot pad 14. As shown in FIGS. 1, 3 and 5, mounting bracketing 18 has a generally circular base portion 58 and a pair of generally triangularly-shaped spaced apart arms 62 and 66 that extend generally upwardly from base portion 58 proximate the perimeter or circumference thereof. As particularly shown in FIG. 3, the upper ends of arms 62 and 66 of mounting bracket 18 are positioned inside and between arms 50 and 54 of bracket 46. The particular positioning of arms 62 and 66 relative arms 50 and 54 is not particularly critical, except with regard to the particular manner in which foot pad 14 is pivotally attached, secured or otherwise mounted on mounting bracket 18. For example, arms 50 and 54 can be replaced with a single arm or hinge that is elongated along a horizontal axis and extends downwardly so that it is positioned between upwardly extending arms 62 and 66 for pivotally attaching, securing or otherwise mounting foot pad 14 on mounting bracket 18.

As particularly shown in FIGS. 3 and 5, foot pad 14 is mounted (i.e., by support bracket 46) on mounting bracket 18 for resisted pivotal movement about a substantially horizontal axis indicated generally as 70 that extends transversely underneath the ankle section 38 of foot pad 14. Foot pad 14 is attached, secured or otherwise pivotally mounted on mounting bracket 18 by a mechanism that is shown (see especially FIG. 3) as involving a combination of a horizontal pivot assembly indicated generally as 74 and a horizontal pivot resistance assembly indicated generally as 78. While horizontal pivot resistance assembly 78 is shown in the FIGs. as being on the right side, with horizontal pivot assembly 74 on the left side, of exercise device 10, these respective assemblies can also be mounted on the opposite or reverse side, especially depending upon whether the user of device 10 is left handed or right handed. Horizontal pivot assembly 74 includes a horizontal pivot member in the form of a bolt 82 having a shaft 84 that is aligned and coextensive with horizontal axis 70. Shaft 84 of bolt 82 initially extends through a flanged bushing 86 with the inner narrower diameter portion of bushing 86 being inserted through a hole or bore 90 formed in arm 50. Shaft 84 of bolt 82 also extends through a hole or bore 94 formed in the upper end of arm 62, as well as a washer 98, and is then secured at one end thereof by a suitable fastener such as nut 102.

Horizontal pivot resistance assembly 78 includes a horizontal pivot member in the form of a bolt 106 having a shaft 108 that is also aligned and coextensive with horizontal axis 70. Shaft 108 of bolt 106 initially extends through a hole or bore 110 formed in the upper end of arm 66 of mounting bracket 18, and then through a flanged bushing 114, with the inner narrower diameter portion of bushing 114 being inserted through a hole or bore 118 formed in the upper end of arm 54. As shown in FIG. 3, assembly 78 also includes an inner annular friction pad 122 that surrounds the inner portion of bushing 114 and is positioned between arm 66 of mounting bracket 18 and arm 54 of support bracket 46. As also shown in FIG. 3, assembly 78 further includes an outer annular friction pad 126 that surrounds the outer portion of bushing 114 and is positioned adjacent to arm 54 of support bracket 46 such that the opposite sides or surfaces of arm 54 are sandwiched between inner friction pad 122 and outer friction pad 126. Friction pads 122 and 126 are typically made from a solid relatively firm material that is the same or similar to that used in brake linings of an automobile. As a result of the combination of friction pads 122 and 126 that enclose and engage the respective opposite sides or surfaces of arm 54, frictional resistance occurs as foot pad 14 is pivoted about horizontally aligned shafts 84 and 108 defining horizontal axis 70.

Shaft 108 of bolt 106 further extends through an inner washer 130 and an outer spring washer 134. Assembly 78 further includes a horizontal tension adjusting member in the form of a knob or handle 140 that is shown as being secured at one end of shaft 108. Knob 140 can be turned or twisted to adjust the amount tension created by compressing (or uncompressing) inner pad 122 and outer pad 126 against arm 54, and can thus control the amount of resistance (i.e., by increasing or decreasing the amount of resistance) or pressure imparted by horizontal pivot resistance assembly 78 to the horizontal pivotal movement (i.e., up and down movement) of foot pad 14 about horizontal axis 70. As knob 140 is twisted or turned, washers 130 and 134 insure that equal pressure is imparted by the tension created by the twisting/turning of knob 140. The pivot arc of foot pad 14 is limited downwardly or upwardly about horizontal axis 70 by base member 22, as well as the extent to which the ankle of the user can be flexed upwardly or downwardly.

As particularly shown in FIGS. 3 and 5, mounting bracket 18 is secured, attached or otherwise mounted on base member 22 for resisted pivotal movement about a substantially vertical axis indicated generally as 144. As particularly shown in FIGS. 3 and 4, vertical axis 144 extends from base 22 and through the ankle section 38 of foot pad 14, intersects horizontal axis 70, and is substantially orthogonal to horizontal axis 70. Vertical pivotal movement of mounting bracket 18 relative to base 22 about vertical axis 144 is controlled by a mechanism in the form of a vertical pivot resistance assembly indicated generally as 148. Assembly 148 includes a vertical pivot member in the form of a base pin 152 having a shaft 154 that is aligned and coextensive with vertical axis 144 and extends vertically upwardly through a flanged bushing 156. The upper narrower diameter portion of bushing 156, as well as shaft 154 of base pin 152, extend through a bore 160 in hub 164 of base member. Hub 164 extends or protrudes upwardly from the upper surface of base member 22. Assembly 148 further includes a lower annular friction plate 168 and an upper annular friction pad 172 that are each of generally the same diameter and are vertically stacked in an adjacent and opposed relationship to provide frictional resistance as mounting bracket 18 pivots relative to base member 22. Annular friction plate 168 is attached or secured within an annular recess 176 formed in the upper surface of base member 22. Annular friction pad 172 is made from the same or similar material as pads 122 and 126 and is attached or secured to the underside of the base portion 58 of mounting bracket 18. While the vertical stacking arrangement shown in FIG. 3 has annular friction plate 168 below annular friction pad 172, the opposite or reverse configuration could also be employed, i.e., annular friction pad 172 being positioned below annular friction plate 168.

As shown in FIG. 3, shaft 154 of base pin 152 is surrounded by the vertical stack of annular friction plate 168 and annular friction pad 172 and extends through a bore 184 formed in hub 180 that is formed in base portion 58 of mounting bracket 18. As also shown in FIG. 3., the upper surface of hub 164 of base member 22 is sized and configured to be received by and fit within the underside of hub 180 of mounting bracket 18. As also shown in FIG. 3, hub 164 of base 22 and hub 180 of mounting bracket 18, as well as the respective bores 160 and 184 through which shaft 154 of base pin 152 extends, are aligned with vertical axis 144 such that mounting bracket 18/foot pad 14 can pivot about vertical shaft 154 defining vertical axis 144, relative to base member 22.

The upper end of hub 180 has a circular recess 188 which receives, in stacked vertical order, a lower washer 192 and an upper spring washer 196 of vertical pivot assembly 148. Shaft 154 of base pin 152 extends through washers 192 and 196 and is then has attached or secured at the upper end thereof a vertical tension adjusting member in the form of knob or handle 200. Knob 200 can be turned or twisted to adjust the amount tension created by compressing (or uncompressing) friction pad 172 against friction plate 168, and can thus control the amount of resistance (i.e., by increasing or decreasing the amount of resistance) imparted by vertical pivot resistance assembly 148 to vertical pivotal movement (i.e., lateral, left or right movement) of mounting bracket 18/foot pad 14 about the vertically extending shaft 154 defining vertical axis 144. As knob 200 is twisted or turned, washers 188 and 192 insure that equal pressure is imparted by the tension created by the twisting/turning of knob 200.

As shown in FIG. 5, base portion 58 of mounting bracket 18 has a rearwardly positioned substantially horizontal arcuate slot indicated as 204. This arcuate slot 204 receives a corresponding arcuate-shaped stop indicated as 208 that extends or protrudes upwardly from the upper surface of base member 22. The configuration and positioning of slot 204 and stop 208 is such as to provide a mechanism for controlling the degree of arc that mounting bracket 18 and foot pad 14 can pivot about vertical axis 144, i.e., the foot pad 14 has a maximum arc defined by the combination of slot 204 and stop 208 that foot pad 14 can pivot about vertical axis 144. For example, slot 204 and stop 208 can control this arc such that foot pad 14 can be pivoted laterally left about vertical axis 144 such that the left side 212 of foot pad 14 is substantially parallel to left edge 216 of base member 22, or right about vertical axis 144 such that the right side 220 of foot pad 14 is substantially parallel with the right edge 224 of base member 22. If desired, the cooperating slot 204 and stop 208 can be made adjustable so that the maximum pivot arc about vertical axis 144 can be smaller or greater as desired by the user. The relative positioning of slot 204 and stop 208 can also be reversed, for example, slot 204 can be formed in the upper surface of base member 22 while stop 208 is formed to project downwardly into this slot from base portion 58 of mounting bracket 18 by appropriate modification. Alternatively, slot 204 can be in the forward area of base portion 58 of mounting bracket 18, with stop 208 being formed/positioned in base member 22 to conform to this alternative positioning of slot 204.

As shown particularly in FIG. 5, base member 22 can also be provided with a handle for grasping it, such as in the form of the hand-grip configured elongated aperture or slot indicated generally as 228 in the middle of the forward edge of base member 22 so that the user can easily carry exercise device 10. Base member 22 can also be provided with weights, or other mechanisms (e.g., velcro-type components) for securing exercise device 10 to the floor or surface on which it is placed, so that device 10 does not undesirably shift position during use.

In operation, the foot of the user is placed on foot pad 14 and is secured by strap 24 that is wrapped around the foot at a point typically between the instep and toes thereof. Once the foot is secured, the user can then subject their foot to downward (plantarflexion) or upward (dorsiflexion) motion, lateral inward (adductor) or lateral outward (abductor) motion in whatever order, degree or number of repetitions the user desires. For plantarflexion motion, the user usually pushes foot pad 14 downwardly as far as possible using the front part of the foot such that foot pad 14 pivots downwardly about horizontal axis 70, typically and depending upon the user, up to as much as about 20° below the horizontal plane, i.e., the place parallel with the surface on which exercise device 10 is placed. This downward, plantarflexion motion typically exercises the muscles in the posterior compartment of the lower leg or shin. For dorsiflexion, the user usually pulls foot pad 14 back with their foot upwardly as far as possible (preferably without using the heel) such that foot pad 14 pivots upwardly about horizontal axis 70, typically and depending upon the user, up to as much as about 45° above the horizontal plane. This upward, dorsflexion motion typically exercises the muscles in the anterior compartment of the lower leg or shin. The degree of resistance or tension exerted against such downward or upward motion can be controlled by adjusting the tension imparted by twisting or turning knob 140. Indeed, instead of horizontal pivot assembly 74 on the left side of exercise device 10, another complementary horizontal pivot resistance assembly 78 could be substituted therefore to provide additional flexibility in controlling the degree of resistance or tension exerted against such downward or upward motion, and especially to increase the degree of such tension or resistance exerted.

For Lateral adductor or abductor motion, the user typically turns foot pad 14 by twisting their foot inwardly or outwardly so as to cause foot pad 14 to pivot about vertical axis 144. The degree to which foot pad 14 can be pivoted about vertical axis 144 depends on the user of the device, as well as the maximum pivot arc left or right about vertical axis 144 that is permitted by the combination of slot 204 and stop 208. Typically, and depending upon the user, this maximum pivot arc can be up to about 45° on either side (i.e., left or right) of the vertical plane that includes vertical axis 144 when horizontal axis 70 is orthogonal to this vertical plane. Inward, adductor motion typically exercises the muscles that are attached medially on the foot, such as the tibailis anterior and the posterior, extensor and flexor hallucis longus. Outward, abductor motion typically exercises the muscles that are attached laterally on the foot, such as the fibularis longus, brevis, and tertius. Again, the degree of resistance or tension exerted against such inward or outward motion can be controlled by adjusting the tension imparted by twisting or turning knob 200.

While specific embodiments of this invention have been described, it will be apparent to those skilled in the art that various modifications thereto can be made without departing from the spirit and scope of this invention as defined in the appended claims.

What is claimed is:

1. An exercise device, which comprises:

A. a base member; and

B. a foot receiving member having a back heel section, a forward toe section and an ankle section adjacent to and offset towards the heel section;

C. the foot receiving member being mounted on and connected to the base member for resisted pivotal movement solely about each of:

1. a substantially horizontal axis extending transversely and underneath the ankle section of the foot receiving member for subjecting a user's foot to plantarflexion or dorsiflexion motion; and 2. a substantially vertical axis extending from where the foot receiving member is connected to the base member and through the ankle section of the foot receiving member for subjecting the user's foot to adductor or abductor motion;

D. the vertical axis being substantially orthogonal to the horizontal axis;

E. means for imparting resistance to pivotal movement about the horizontal axis; and F. means for imparting resistance at the vertical axis to pivotal movement about the vertical axis.

2. The device of claim 1 wherein the vertical axis and horizontal axis intersect.

3. The device of claim 1 which further comprises a mechanism for adjusting the amount of resistance to pivotal movement of the foot receiving member about at least one of the vertical axis and the horizontal axis.

4. The device of claim 3 which comprises at least one mechanism for adjusting the amount of resistance to pivotal movement of the foot receiving member about each of the vertical axis and the horizontal axis.

5. The device of claim 1 which further comprises a slot and a stop member received by the slot that cooperate to control the degree of arc that the foot receiving member can pivot about the vertical axis.

6. The device of claim 5 wherein the degree of arc that the foot receiving member can pivot about the vertical axis is up to about 45° on either side of a vertical plane that includes the vertical axis.

7. The device of claim 1 which further comprises a foot securing member for releasably securing a foot of the user to the foot receiving member.

8. The device of claim 7 wherein the foot securing member can be adjustably secured to the foot receiving member at a position between the ankle section and the toe section.

9. An exercise device, which comprises:

A. a base member;

B. a mount member;

C. a foot pad having a back heel section, a forward toe section and an ankle section adjacent to and offset towards the heel section, the foot pad being pivotally attached to the mount member for resisted pivotal movement solely about a substantially horizontal axis extending transversely and underneath the ankle section of the foot pad for subjecting a user's foot to plantarflexion or dorsiflexion motion;

(D). the mount member being pivotally attached to the base member for resisted pivotal movement solely about a substantially vertical axis extending from the base member and through the ankle section of the foot pad for subjecting the user's foot to adductor or abductor motion;

E. means for imparting resistance to pivotal movement about the horizontal axis; and F. means for imparting resistance at the vertical axis to pivotal movement about the vertical axis.

10. The device of claim 9 wherein the mount member comprises a base portion that is adjacent and attached to the base member for the pivotal movement about the vertical axis, and at least one arm extending generally upwardly from the base portion, the foot pad being pivotally attached to the at least one upwardly extending arm for the pivotal movement about the horizontal axis.

11. An exercise device, which comprises:

A. a base member,

B. a foot pad having a back heel section, a forward toe section and an ankle section adjacent to and offset towards the heel section;

C. a support bracket attached to the foot pad and having a pair of spaced apart generally downwardly extending arms; and D. a mount member having:

(1) a base portion adjacent and attached to the base member for resisted pivotal movement about a substantially vertical axis extending from the base member and through the ankle section of the foot pad for subjecting a user's foot to adductor or abductor motion; and (2) a pair of spaced apart arms extending generally upwardly from the base portion;

E. wherein each downwardly extending arm is pivotally mounted on one of the upwardly extending arms for resisted pivotal movement of the foot pad about a substantially horizontal axis extending transversely and underneath the ankle section of the foot pad for subjecting the user's foot to plantarflexion or dorsiflexion motion;

F. means for imparting resistance to pivotal movement about the horizontal axis; and;

G. means for imparting resistance at the vertical axis to pivotal movement about the vertical axis.

12. The device of claim 11 which comprises at least one horizontal pivot resistance assembly for pivotally mounting at least one of the downwardly extending arms on one of the upwardly extending arms and for imparting resistance to pivotal movement about the horizontal axis.

13. The device of claim 12 which comprises one horizontal pivot resistance assembly for pivotally mounting one of the downwardly extending arms on one of the upwardly extending arms and which further comprises a horizontal pivot assembly for pivotally mounting the other downwardly extending arm on the other upwardly extending arm.

14. The device of claim 13 wherein the horizontal pivot resistance assembly comprises a horizontal pivot member aligned with the horizontal axis, at least one friction pad surrounding the horizontal pivot member and engaging one of the downwardly extending arms and a horizontal tension adjustment member that can cause the at least one friction pad to be compressed or uncompressed against the one downwardly extending arm so as to control the amount of resistance imparted by the at least one horizontal pivot resistance assembly to the horizontal pivotal movement of the foot pad about the horizontal pivot member.

15. The device of claim 14 wherein the at least one friction pad comprises a pair of spaced apart friction pads, each friction pad engaging one opposite side of the one downwardly extending arm.

16. The device of claim 11 wherein the base member has a first hub protruding upwardly therefrom and aligned with the vertical axis, and wherein the mount member has a second hub aligned with the vertical axis and sized and configured to receive the first hub such that the mount member can pivot about the vertical axis.

17. The device of claim 11 which further comprises a substantially horizontal arcuate slot formed in one of the base member and the mount member, and an arcuate stop formed in the other of the base member and the mount member and extending into the arcuate slot so as to control the degree of arc that the foot pad can pivot about the vertical axis.

18. The device of claim 11 further comprising a strap that can be releasably secured to the foot pad between the ankle section and the toe section.

19. The device of claim 14 which comprises a vertical pivot resistance assembly for pivotally mounting the mount member on the base member and for imparting resistance at the vertical axis to pivotal movement about the vertical axis.

20. The device of claim 19 wherein the vertical pivot resistance assembly comprises a vertical pivot member aligned with the vertical axis, a friction pad and a friction plate surrounding the vertical pivot member in a vertically stacked adjacent and opposed relationship, and a vertical tension adjustment member that can cause the friction pad to be compressed or uncompressed against the friction plate so as to control the amount of resistance imparted by the vertical pivot resistance assembly at the vertical pivot member to the vertical pivotal movement about the vertical pivot member.

* * * * *